US005296661A

United States Patent [19]

Pham et al.

[11] Patent Number: 5,296,661

[45] Date of Patent: Mar. 22, 1994

[54] HYBRID CIRCUIT-BREAKER FOR INTERRUPTING CURRENTS HAVING HIGH DC COMPONENTS

[75] Inventors: Van Doan Pham, Meyzieu; Robert Jeanjean; Armand Scarato, both of Lyons; Jean-Pierre Arandel, Civrieux D'Azergues, all of France

[73] Assignee: GEC Alsthom SA, Paris, France

[21] Appl. No.: 977,287

[22] Filed: Nov. 16, 1992

[30] Foreign Application Priority Data

Nov. 20, 1991 [FR] France ..... 91 14348

[51] Int. Cl.[5] ..... H01H 33/82; H01H 33/14

[52] U.S. Cl. ..... 200/148 R; 200/145

[58] Field of Search ..... 200/144 AP, 145, 148 B, 200/148 D, 148 E, 148 F, 148 H, 148 R; 361/13

[56] References Cited

U.S. PATENT DOCUMENTS

| | | | |
|---|---|---|---|
| 2,894,100 | 7/1959 | Hoffman | 200/146 |
| 3,227,924 | 1/1966 | Wutz | 317/11 |
| 4,204,101 | 5/1980 | Dethlefsen | 200/144 AP |
| 4,216,513 | 8/1980 | Tokuyama et al. | 361/13 |
| 4,531,031 | 7/1985 | Freeman et al. | 200/82 B |

*Primary Examiner*—Jeffrey A. Gaffin
*Assistant Examiner*—Michael A. Friedhafer
*Attorney, Agent, or Firm*—Sughrue, Mion, Zinn, Macpeak & Seas

[57] ABSTRACT

A hybrid circuit-breaker for interrupting currents having high DC components, said hybrid circuit-breaker comprising a compressed-air circuit-breaker that recloses automatically, and a sulfur hexafluoride circuit-breaker, the circuit-breakers being disposed in series.

3 Claims, 3 Drawing Sheets

HYBRID CIRCUIT-BREAKER FOR INTERRUPTING CURRENTS HAVING HIGH DC COMPONENTS

The present invention relates to the interrupting of currents having high DC components, e.g. such as are encountered when certain types of fault occur in high-voltage AC grids having series compensation. The presence of the DC component may prevent the current passing through current zero for several periods. It is then difficult to interrupt the current by using conventional arc blasting or puffer methods which blast the arc strongly when the amplitude of the current passes through current zero.

BACKGROUND OF THE INVENTION

It is well known that in order to remedy that drawback, the arcing voltage must be increased by using suitable means. A high arcing voltage makes it possible to absorb the energy from the DC component of the current and to cause the DC component tend towards zero.

Using an interrupting chamber having permanent fuses in series with a conventional high-voltage circuit-breaker has been proposed. During breaking as a result of a fault, the fact that the fuses melt produces a very high arcing voltage which causes the DC component of the fault current to decrease very quickly.

Using a high-pressure interrupting chamber equipped with means for creating a plurality of arcs in series has also been proposed.

Such solutions require new equipment to be used. An object of the present invention is to make a circuit-breaker that is capable of creating a high arcing voltage, by using existing equipemnt that is available on the market, and making only a cheap minor technical modification.

It is known that high-pressure compressed-air circuit-breakers can create high arcing voltages that are more than ten times the arcing voltages of sulfur hexafluoride ($SF_6$) circuit-breakers. Such conventional compressed-air circuit-breakers have been used for a long time now in high-voltage and very high-voltage grids. To this end, reference is made to the article "Appareillage haute tension" by E. Thuries et Pham Van Doan, Avenir du Génie Electrique, Colloque National organized by the Ministère de la Recherche, Actes, 28–29 January 1987, Paris.

Compressed-air circuit-breakers are used in particular in very cold regions where ambient temperature can drop to −50° C.

At that temperature, the $SF_6$ may condense if the pressure inside the interrupting chamber of the circuit-breaker is not low enough.

U.S. Pat. No. 4 204 101 describes a vacuum interrupter and an $SF_6$ interrupter associated together in series. That association does not enable the arcing voltage to be increased.

U.S. Pat. No. 3 227 924 describes two circuit-breakers associated together in series having different dielectric recovery rates. That association makes it possible to maintain electrical isolation after interruption, but not to increase the arcing voltage before interruption.

The invention provides a hybrid circuit-breaker including, for each phase, compressed-air interrupting chambers and $SF_6$ interrupting chambers, the resulting assembly making it possible to interrupt fault currents that pass through current zero with a delay because of their high DC component.

The purpose of compressed-air interrupting chambers is similar to that of permanent-fuse interrupting chambers or to that of multiple-arc interrupting chambers: it is to create an arcing voltage that is sufficiently high.

The purpose of the $SF_6$ chambers is to interrupt the current on current zero and to isolate the circuit.

A resistor of several thousand ohms or a capacitor of the order of several hundreds of thousands of picofarads is disposed across the terminals of each compressed-air interrupting chamber. As a result, when in the open position while live, there is no voltage stress on the compressed-air interrupting chambers. It should be noted that at the time of interruption, the arcing voltage may reach several tens of kilovolts. Using a high-capacitance capacitor of several hundreds of thousands of picofarads across the arcing terminals may make the arc unstable because of current oscillations via a low-inductance inductor or via the inductance of the connection in series with the capacitor. Such instability helps to increase the arcing voltage and to decrease the current towards zero. To this end, reference is made to the following articles:

"L'oscillation arc-capacité et son utilisation pour l'évaluation des paramètres caractéristiques d'un arc électrique" by A. Mohssen Zeneldien, Thesis, University of Grenoble, 5 June 1974;

"HVDC circuit breakers using oscillating current techniques", by Yamada et al., Direct Current, 1966, No. 8; and "DC circuit breaker", U.S. Pat. No. 4 216 513 of 5ÅAugust 1980, Hitachi Ltd.

The absence of voltage stress on the compressed-air interrupting chambers means that the casings for the compressed-air interrupting chambers can be made of a composite material, e.g. glass fibers impregnated with epoxy, with fins made of silicone or of EPDM. High compressed-air pressures can then be used and any explosions that are always possible when ceramics are used can be avoided.

In order to provide near-perfect operating safety, the compressed-air interrupting chamber re-closes automatically, i.e. after it has been opened, its moving contact re-closes automatically and quickly in a few hundredths of a second instead of several tens of hundredths of a second, as is usually the case in conventional circuit-breakers in which electrical open or close commands are given on the basis of the indications supplied by the auxiliary contacts (also referred to as "signal contacts").

SUMMARY OF THE INVENTION

The invention thus provides a hybrid circuit-breaker for interrupting currents having high DC components, said hybrid circuit-breaker comprising firstly a compressed-air circuit-breaker including at least one interrupting chamber having its terminals connected in parallel either with a resistor of several thousand ohms or with a capacitor of several hundreds of thousands of picofarads, and secondly a sulfur hexafluoride ($SF_6$) circuit-breaker including at least one interrupting chamber, the two circuit-breakers being disposed in series and being controlled so that they open substantially simultaneously or so that the compressed-air circuit-breaker opens a few thousandths of a second earlier than the $SF_6$ circuit-breaker, the compressed-air circuit-breaker including means for ensuring that a close command is given to it automatically in the range 2 hundredths of a second to 3 hundredths of a second after an open command.

Preferably, the interrupting chambers of the compressed-air circuit-breaker are made of a composite material such as glass fibers impregnated with epoxy resin, with fins made of silicone or of EPDM.

Advantageously, when the compressed-air circuit-breaker includes an opening valve driven by compressed air being taken into a first duct, the intake of the compressed air being dependent on an opening control valve driven by a drive rod, and a closing valve driven by compressed air being taken into a second duct, said means comprise a pipe that interconnects said first duct and said second duct.

BRIEF DESCRIPTION OF THE DRAWINGS

An embodiment of the invention is described by way of example with reference to the accompanying drawings, in which.

DETAILED DESCRIPTION

Figure 1:
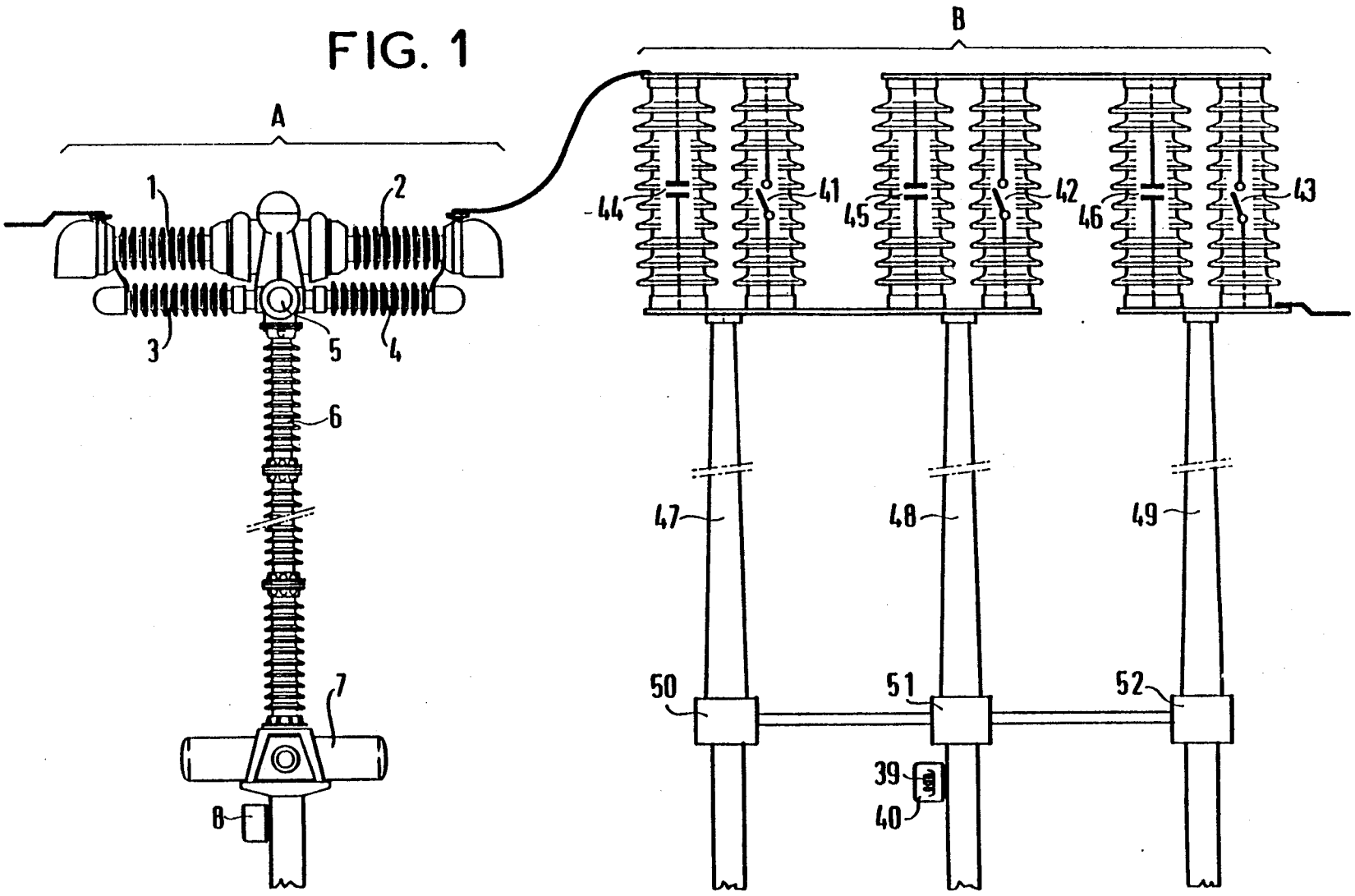
FIG. 1 is a diagrammatic elevation view of a hybrid circuit-breaker of the invention.

The embodiment of the hybrid circuit-breaker of the invention is a circuit-breaker having nominal voltage of 800ÅkV and comprising a compressed-air circuit-breaker having two chambers in series, and an $SF_6$ circuit-breaker having three interrupting chambers in series.

The chambers of the compressed-air circuit-breaker (A) are referenced 1 and 2. Each of them has a casing made of a composite material such as glass fiber impregnated with epoxy resin, with fins made of silicone or of EPDM. Resistors 3 and 4, of high resistance (of the order of several thousand ohms), are electrically connected in parallel to the chambers 1 and 2 respectively. In a variant, the resistors are replaced by capacitors having capacitance of several hundreds of thousands of picofarads. The resistors or the capacitors are installed in insulating casings made of composite material and disposed parallel to the chambers 1 and 2.

The chambers include moving electrical contacts controlled by an opening valve and a closing valve contained in a central tank 5. The chambers are mounted on an insulating column 6 made of ceramic 6. An insulating control rod referenced 9 in FIG. 2 passes through the insulating column. A tank of compressed air 7 and a control 8 are placed at the base of the column 6.

The $SF_6$ circuit-breaker (B) includes $SF_6$ interrupting chambers 41, 42, and 43, equipped with respective distribution capacitors 44, 45, and 46. Capacitors and interrupting chambers are mounted on insulating supports 47, 48, and 49. The chambers are driven by hydraulic, mechanical, or pneumatic controls 50, 51, and 52. The controls are dependent on a winding 39 powered when a command is given by a control box 40.

Figure 2:
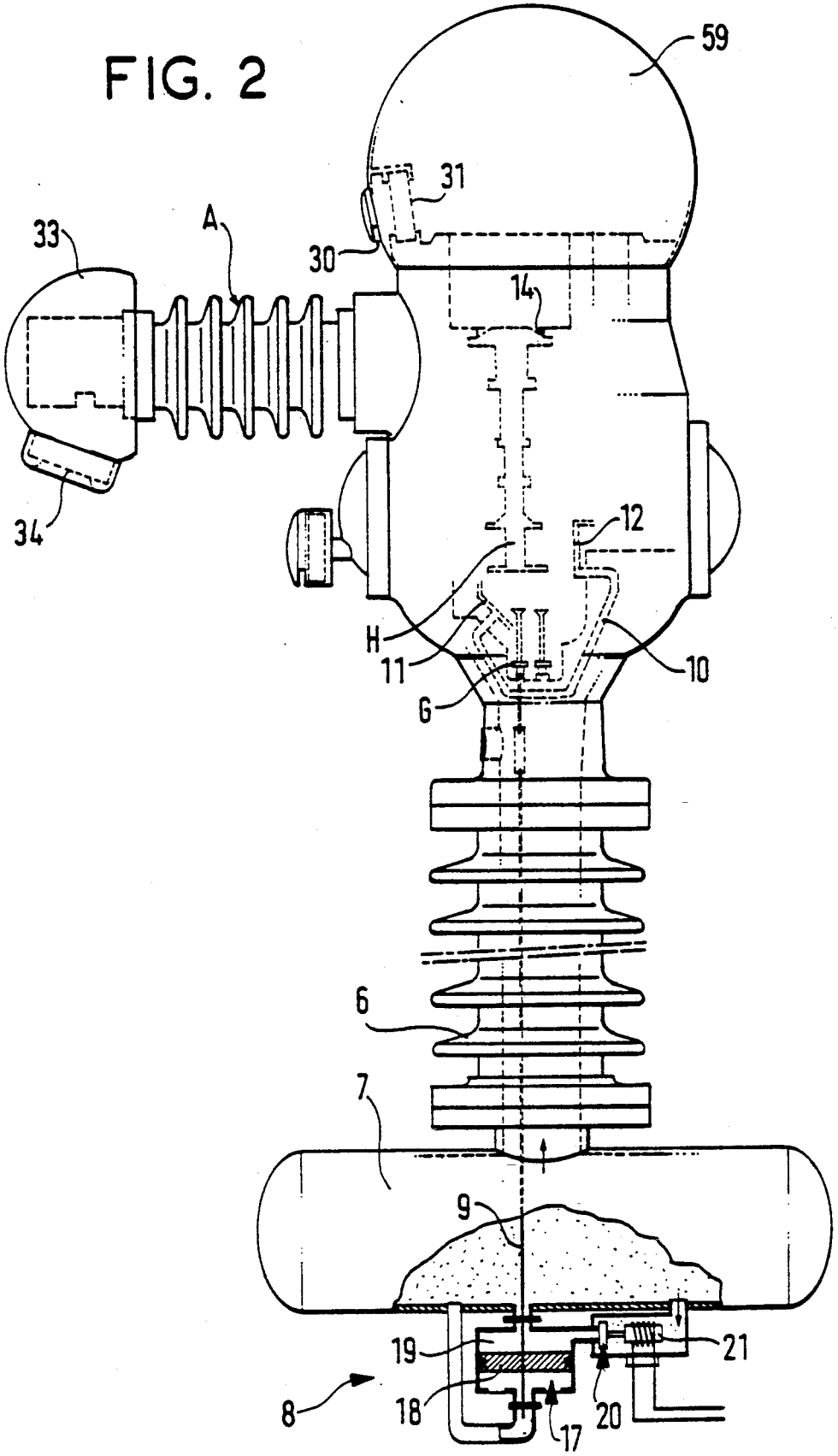
FIG. 2 is an elevation view of a pole of a compressed-air circuit-breaker.
Figure 3:
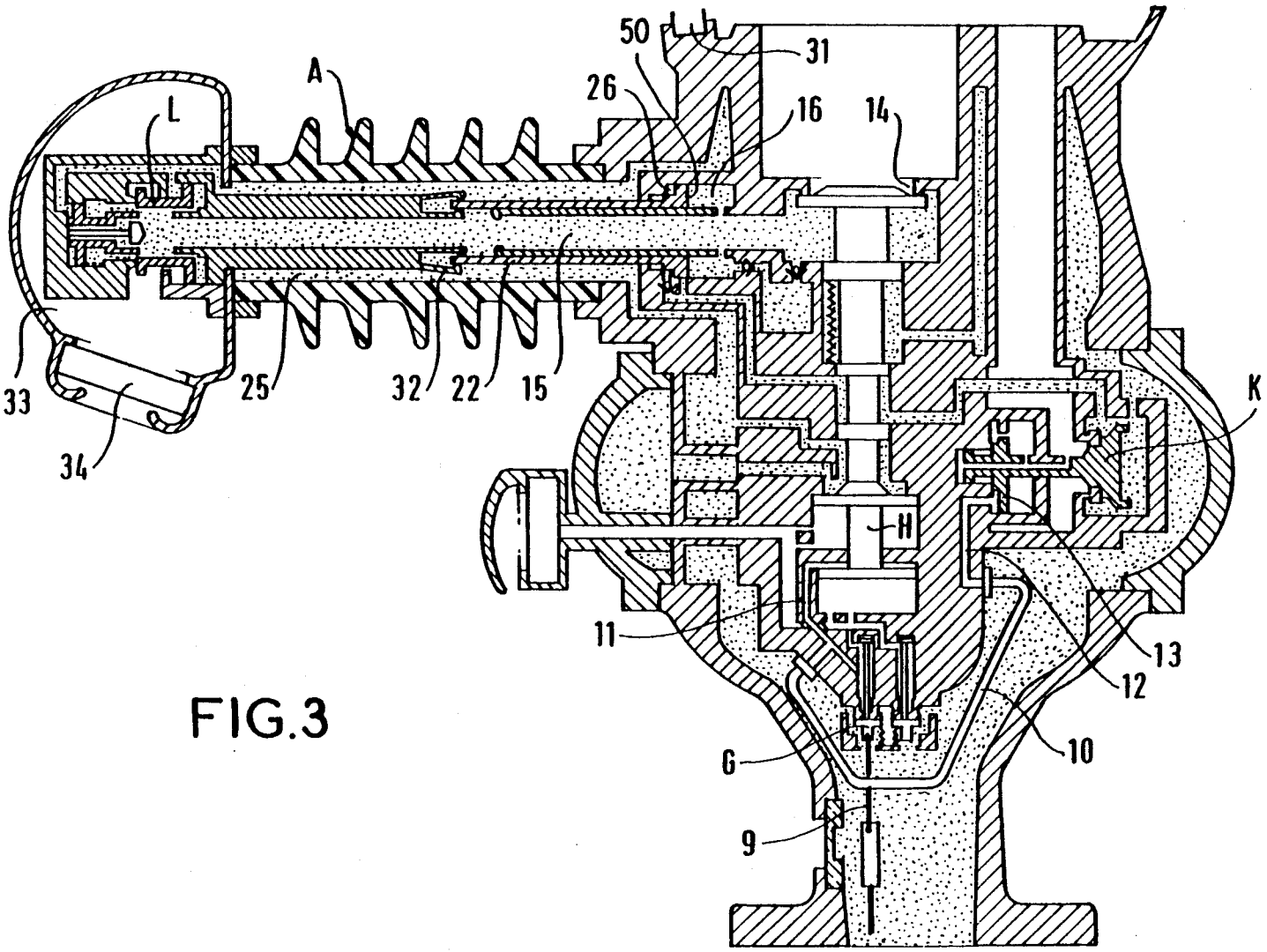
FIG. 3 is a view in axial section through a compressed-air interrupting chamber with its make and break mechanism.

FIG. 2 shows an embodiment of the compressed-air circuit-breaker. Only one chamber, namely chamber 1, is shown, the other chamber being completely identical. In order to make the drawing clearer, the resistor 3 is not shown. FIG. 3 shows the interrupting chamber and the make and break mechanism in more detail.

The chamber includes inter alia a fixed arcing contact 32 and a moving arcing contact 22 equipped with a piston 50, an opening valve H controlled by a control valve G, a closing valve K, and a blast valve L.

The control 8 includes a valve 17 including a piston 18, and a solenoid valve 20 controlled by a winding 21. The command given to the winding 21 by the control box 40 FIG. 1, causes the solenoid valve 20 to open and to allow compressed air into the space 19 overlying the piston 18, thereby causing the piston to move downwards towards the bottom of FIG. 2, and, as a result, causing the control valve G FIG. 3, to open and the opening valve H FIG. 3, to move downwards towards the bottom of FIG. 3.

When the opening valve operates, it releases its seat 14. The compressed air in the volume 15 inside the arcing contact 22 flows out towards the space 54, and then towards the atmospheric air via the silencer 31. Reducing the pressure in the volume 15 to atmospheric causes the blast valve L to open automatically. The pressure drop in the volume 16 behind the piston 20 causes the moving arcing contact 22 to be displaced towards right of the FIG. 3 and an electric arc to appear between the contacts 22 and 32. The compressed air in the enclosure 25 flows out towards the spaces 33 and 59, thereby applying a strong blast to the arc as it is displaced towards the right, FIG. 3. The silencers 31 and 34 enable the noise from the blast of compressed air to be reduced. When the contact 22 reaches the end of its stroke, the arc is blasted when the current passes through current zero for the first time.

By interrupting the command to the winding 21 quickly, it is possible to rapidly re-close the solenoid valve 20, the control valve G, and the opening valve H. The puffer valve L re-closes automatically a few hundredths of a second after it has been opened.

According to a characteristic of the invention, a pipe 10 interconnects the inlet channel 11, via which high pressure is applied to the opening valve H, and the inlet channel 12, via which compressed air is applied to the control piston 13 for controlling the closing valve K.

The pipe 10 acts as follows: at the same time as compressed air is being taken in via the channel 11, compressed air also passes through the pipe 10 and penetrates into the channel 12 with a certain delay, of about 2 to 3 hundredths of a second, to operate the closing valve K. When the valve K operates, the space 26 in front of the piston 50, FIG. 3, is connected to the atmosphere, and the circuit-breaker is re-engaged because of the high pressure that is present inside the space or volume 16 behind the piston 50 as a result of the valve H being closed.

In this way, the compressed-air circuit-breaker can be reclosed quickly and automatically after it has been opened, without requiring a make rod or a closing solenoid valve.

By opening the compressed-air circuit-breaker for a very short time, it is possible to increase the arcing voltage sufficiently to enable the current to pass through current zero so that it can then be interrupted easily by the $SF_6$ circuit-breaker.

The duration during which the compressed-air circuit-breaker remains open is adjusted by selecting the length and the cross-sectional area of the pipe 10. If necessary, the pipe 10 may go round the valve H several times.

It is necessary for the interrupting chambers in the compressed-air circuit-breaker and the interrupting chambers in the $SF_6$ circuit-breaker to open simultaneously, or preferably for those in the compressed-air circuit-breaker to open a few milliseconds before those in the $SF_6$ circuit-breaker.

It should be noted that in order to avoid any error or delay in commands, the open electrical command is given simultaneously both to the opening winding 21 FIG. 2, in the compressed-air circuit-breaker and to the opening winding 39 FIG. 1, in the $SF_6$ circuit-breaker, with the two windings either in parallel or in series.

It is possible to operate the valve 17 either directly, or else via a relay with the pneumatic or hydraulic command coming from the control 40 of the $SF_6$ circuit-breaker.

FIG. 3 shows the opening valve H which blasts the gas that is common to both the adjacent interrupting chambers. When a circuit-breaker having two chambers with one opening valve per chamber is used, using the pipe 10 for re-closing remains valid.

We claim:

1. A hybrid circuit-breaker for interrupting currents having high DC components, said hybrid circuit-breaker comprising firstly a compressed-air circuit-breaker including at least one interrupting chamber having terminals thereof connected in parallel with an impedance selected from a resistance of several thousand ohms and a capacitance of several hundreds of thousands of picofarads, and secondly a sulfur hexafluoride circuit-breaker including at least one interrupting chamber, said first and second circuit-breakers being connected in series and said hybrid circuit-breaker further comprising the means for controlling said first and second circuit-breakers for opening said first and second circuit-breakers substantially simultaneously or with the compressed-air circuit-breaker opening a few thousandths of a second earlier than the $SF_6$ circuit-breaker, and wherein said compressed-air circuit-breaker further includes means for automatically giving a close command to said compressed-air circuit-breaker in the range of 2 hundredths of a second to 3 hundredths of a second after an open command is received by said compressed-air circuit-breaker.

2. A hybrid circuit-breaker according to claim 1, wherein the interrupting chambers of the compressed-air circuit-breaker are made of a composite material such as glass fibers impregnated with epoxy resin, with fins made of silicone or of EPDM.

3. A circuit-breaker according to claim 1, wherein said compressed-air circuit-breaker includes an opening valve driven by compressed air being taken into a first duct, an intake of the compressed air being dependent on an opening control valve driven by a drive rod, said compressed-air circuit-breaker including a closing control valve driven by compressed air being taken into a second duct, and wherein said controlling means comprises a pipe interconnecting said first duct and said second duct.

* * * * *